US006397919B1

(12) United States Patent
Lamsfuss

(10) Patent No.: US 6,397,919 B1
(45) Date of Patent: Jun. 4, 2002

(54) SECTIONAL ROLL-UP DOOR WITH HEATED EDGE SEALS

(76) Inventor: Norbert Lamsfuss, Erzstrasse 2, D-53604 Bad Honnef (DE)

( * ) Notice: Subject to any disclaimer, the term of this patent is extended or adjusted under 35 U.S.C. 154(b) by 0 days.

(21) Appl. No.: 09/860,067

(22) Filed: May 17, 2001

(51) Int. Cl.[7] ..... E05D 15/16
(52) U.S. Cl. ..... 160/201; 62/275
(58) Field of Search ..... 160/201, 236, 160/40; 62/275

(56) References Cited

U.S. PATENT DOCUMENTS 3,055,193 A * 9/1962 Smith
3,869,873 A * 3/1975 Thomas
4,080,764 A * 3/1978 Stowik et al.
5,168,915 A * 12/1992 Lafleur
6,178,763 B1 * 1/2001 Brancheau et al.

* cited by examiner

*Primary Examiner*—Blair M. Johnson
(74) *Attorney, Agent, or Firm*—Herbert Dubno; Andrew Wilford

(57) ABSTRACT

A sectional roll-up door has two generally planar panels having confronting longitudinally extending edges, a hinge between the panels at the edges, a seal extending longitudinally along one of the edges and operatively engageable with the other of the edges, and an element for heating the seal. Each panel comprises a pair of parallel and spaced skins, edge strips bridging the skins and forming the edges, and a mass of insulation between the skins. The heater is provided at the edges.

11 Claims, 4 Drawing Sheets

SECTIONAL ROLL-UP DOOR WITH HEATED EDGE SEALS

FIELD OF THE INVENTION

The present invention relates to a sectional roll-up door. More particularly this invention concerns such a door used on a walk-in refrigerator or generally between a very cold space and a much warmer space.

BACKGROUND OF THE INVENTION

A standard roll-up sectional door has a plurality of horizontally elongated rigid panels having inside and outside faces and upper and lower edges. Hinges on one of the faces between the panels define normally horizontal pivot axes and the ends of the panels are provided with rollers riding in L-shaped guides that each have one leg extending vertically adjacent an opening to be closed by the door and another leg extending horizontally to one side of and above the opening. Thus the door can be moved from a vertical closed position with the panels all lying in an upright plane and their edges engaging each other so as to block the opening to a horizontal open position above the door clear of the opening. As the door moves from the vertical closed position to the horizontal open position the panels pivot relative to each other as they pass from the vertical to the horizontal legs of the guides. During such pivoting the edges separate from each other.

In order to close the opening the edges fit snugly together and are often even provided with flexible or compressible seal strips that, in the closed position, are compressed between the panel edges to tightly seal the joint between adjacent panels. In addition it is standard to make the panels each of a pair of metallic or plastic skins forming the inner and outer faces, a pair of edge strips bridging the skins and holding them apart, and a mass of rigid closed-cell insulation filling the space between the skins and edge strips.

When used, for instance, as the door of a walk-in freezer or in a refrigerator plant, the doors are constituted to have a K-value of at least 0.5 and often as little as 0.2. In such an application the hinges are applied on the outside or warm side and the door rolls up onto this warm side. Thus when the door is rolled up, the edges separate on the cold side and the seals between adjacent panels, which are quite cold, are exposed to warmer air. The result is frost on the seals. The door is normally held open as little time as possible so that this frost does not have time to melt and can, with time, build up enough to interfere with operation of the door. Furthermore the frost can freeze the two panels together, so that the seals tear when the door is opened.

OBJECTS OF THE INVENTION

It is therefore an object of the present invention to provide an improved roll-up sectional door.

Another object is the provision of such an improved roll-up sectional door which overcomes the above-given disadvantages, that is which will not allow frost to build up on the panel edges.

SUMMARY OF THE INVENTION

A sectional roll-up door has according to the invention two generally planar panels having confronting longitudinally extending edges, a hinge between the panels at the edges, a seal extending longitudinally along one of the edges and operatively engageable with the other of the edges, and an element for heating the seal.

Thus according to the invention the seal is kept warm so that, when the door is opened and it is exposed to warm humid air, no frost will form on it. The amount of heating needed is modest and also serves to keep the seal flexible.

According to the invention each panel comprises a pair of parallel and spaced skins, edge strips bridging the skins and forming the edges, and a mass of insulation between the skins. The heater is provided at the edges. The seal can be an elastomeric tube and the heater a wire extending longitudinally inside the tube. Alternately the heater includes a hollow housing extending longitudinally along the edge and a heating element inside the housing. This housing can be fixed to the other edge to engage the seal of the one edge or it can be fixed to one of the skins and bridge the gap between the panel edges. In this latter case the hinges are on the other of the skins. The housing is aluminum.

The heater can also be an element extending longitudinally along the one edge. In this case the seal is an elastomeric strip and extends along an inside face of the edge strip forming the one edge. An insulating strip is provided between the heating element and the insulation mass in the panel.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
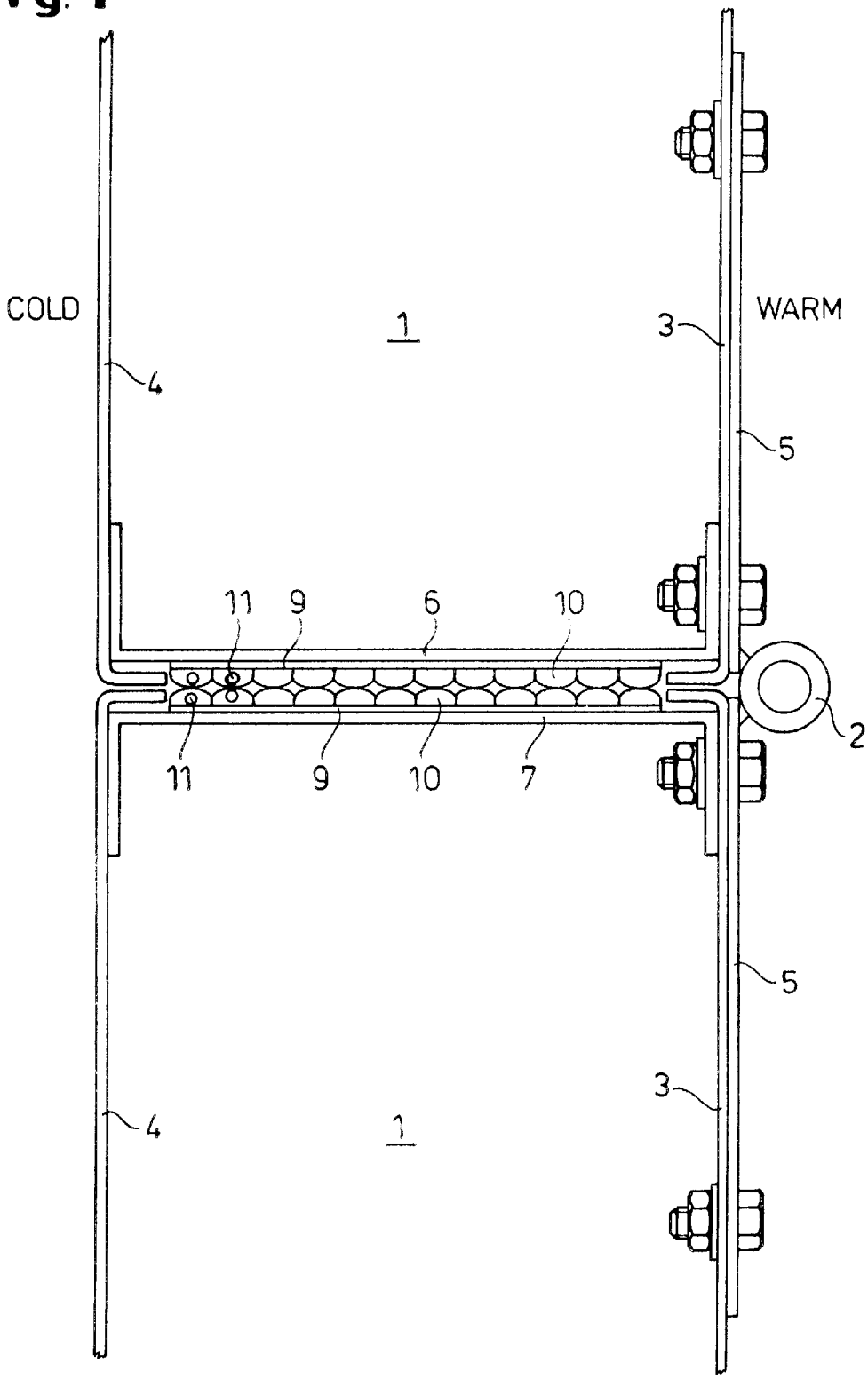
FIG. 1 is a vertical section through a portion of a roll-up garage door according to the invention in the open position.

As seen in FIG. 1 a pair of rigid door panels 1 are arranged one above and are each formed by a cold-side skin 4, a warm-side skin 5, a U-section lower edge strip 6, and a U-section upper edge strip. The parts 3, 4, 6, and 7 are typically made of a fiber-reinforced plastic, and the space between them is filled with a mass 8 (FIG. 2) of closed-cell foam, giving the panels 1 good insulating properties and rigidity. A hinge 2 defining a horizontal pivot axis level with the joint between the panels 1 has a pair of leaves 5 secured to the warm-side panels 3.

Figure 2:
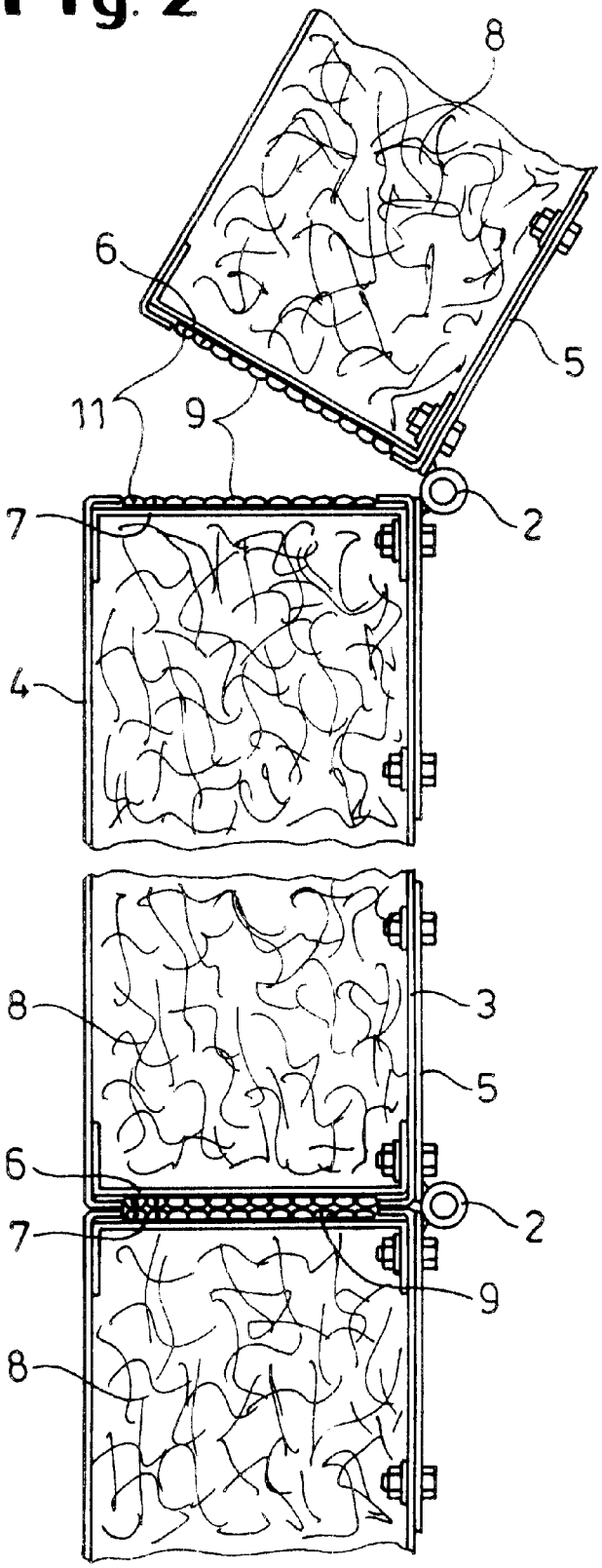
FIG. 2 is a smaller-scale view like FIG. 1 showing the door as it flexes between the closed and open positions.

As shown in FIGS. 1 and 2 the edge strips 6 and 7 are provided with hollow elastomeric seals 9 having longitudinal passages or cavities 10 in which are provided heating wires 11. Thus these seals 9 can be heated in order to prevent frost from forming on them. The wires 11 can be of the resistive-heating type, powered by batteries or line current.

Figure 3:
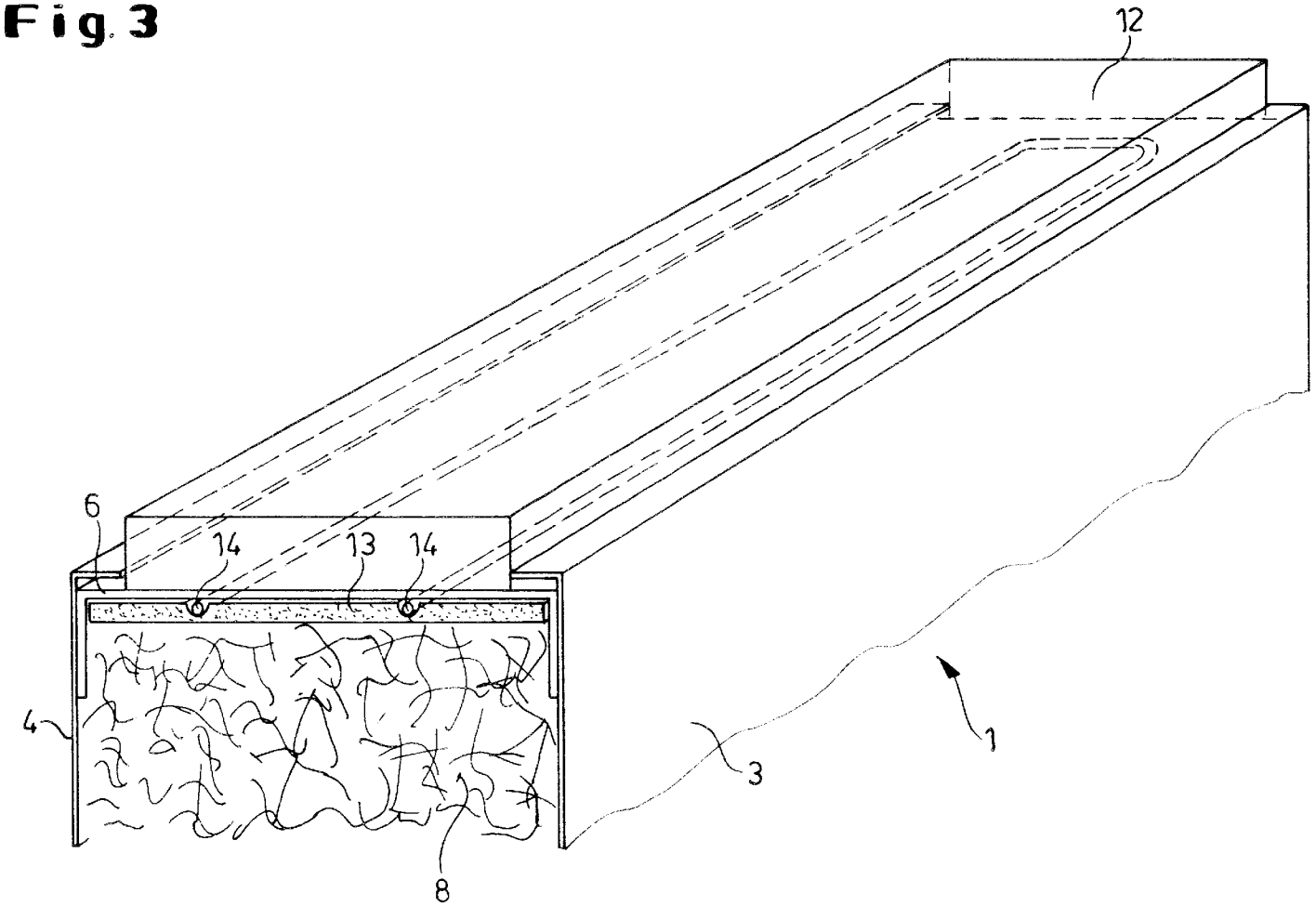
FIG. 3 is a partially sectional end view of another door panel in accordance with the invention.

In the system of FIG. 3 the panel 1 has a rectangular-section seal 12 secured to its edge strip 6. Inside the panel, that is on the inside face of the strip 6, are heating wires 14 overlain by another insulating strip 13 so that the seal 12 can be warmed to prevent frost from forming on it.

Figure 4:
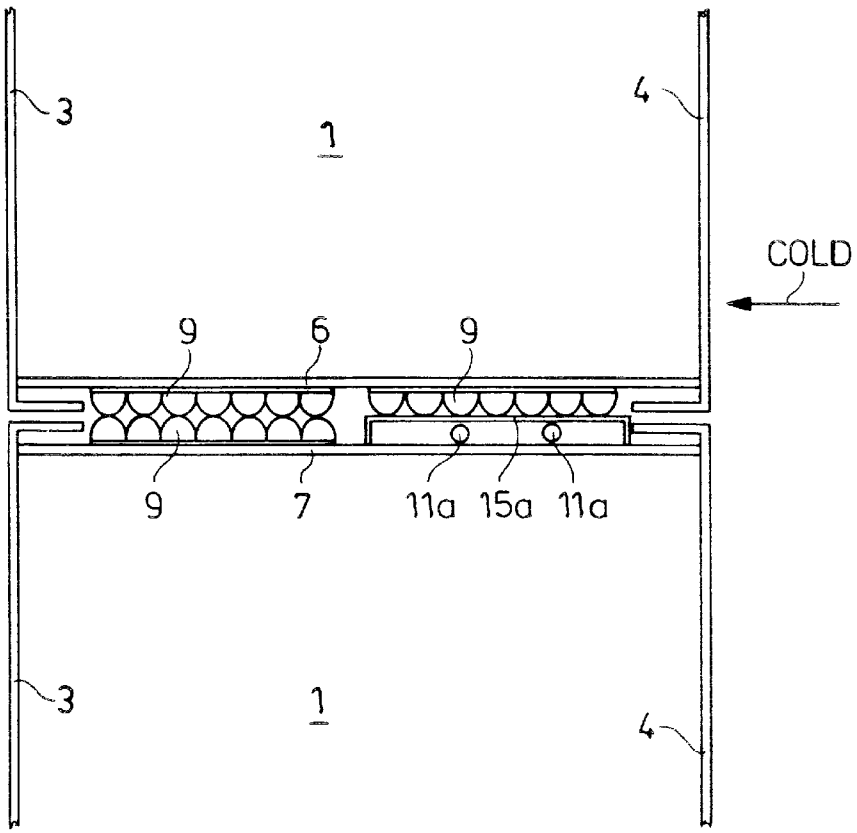

FIG. 4 has an arrangement with two arrays of seals 9 on the lower edge strip 6 opposed on the confronting upper edge strip 7 with, on the warm side, another set of seals 9 and, on the cold side, with a hollow aluminum housing 15*a* extending the full length of the warm-side seals 9 and containing heater wires 11*a*. Thus at this critical region the seals 9 will be warmed to prevent them from frosting up.

Figure 5:
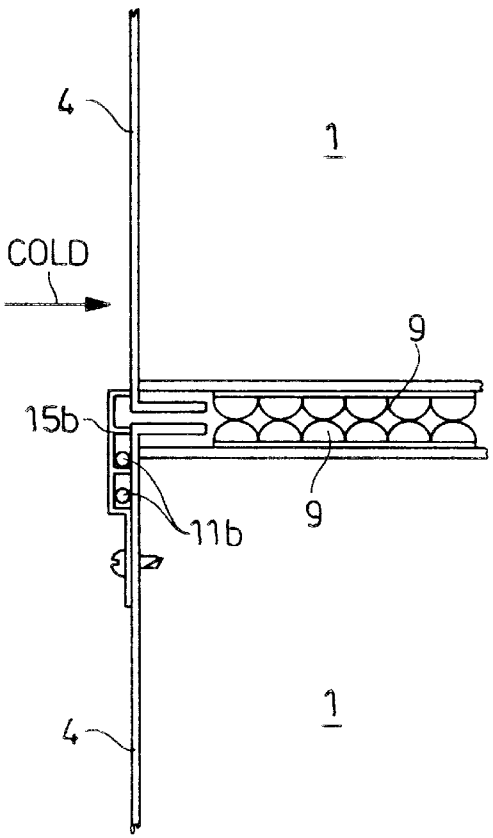
FIGS. 4 and 5 are sectional detail views of further panels according to the invention.

In FIG. 5 a system is shown suitable for retrofitting to an existing roll-up door. Here an elongated hollow aluminum housing 15*b* is secured to the cold-side panel 4 to bridge over the gap between the panels 1 and holds heater wires 11*b*. Thus it is possible to heat the space between the panels 1 and thereby keep the seals 9 warm.

I claim:

1. A sectional roll-up door for a walk-in refrigerator, the door comprising:

two generally planar panels having confronting longitudinally extending edges and each also having a pair of parallel and spaced skins, edge strips bridging the skins and forming the edges, and a mass of insulation between the skins;

a hinge connected to the panels generally at the edges;

a seal extending longitudinally along one of the edges and operatively engageable with the other of the edges, the door being movable between a closed position with the edges closely juxtaposed and the seal compressed between the edges and an open position with the edges spread apart from each other and the seal exposed; and means for heating the seal.

2. The sectional roll-up door defined in claim 1 wherein the heating means is provided at the edges.

3. The sectional roll-up door defined in claim 1 wherein the seal is an elastomeric tube and the heating means is a wire extending longitudinally inside the tube.

4. The sectional roll-up door defined in claim 1 wherein the heating means includes a hollow housing extending longitudinally along the edge and a heating element inside the housing.

5. The sectional roll-up door defined in claim 4 wherein the housing is fixed to the other edge and engages the seal of the one edge.

6. The sectional roll-up door defined in claim 4 wherein the edge strips define a gap between the edges.

7. The sectional roll-up door defined in claim 6 wherein the hinge is fixed to the skins.

8. The sectional roll-up door defined in claim 4 wherein the housing is aluminum.

9. The sectional roll-up door defined in claim 1 wherein the heating means is an element extending longitudinally along the one edge.

10. The sectional roll-up door defined in claim 9 wherein the seal is an elastomeric strip.

11. The sectional roll-up door defined in claim 10 wherein the heating element extends along an inside face of the edge strip forming the one edge.

* * * * *